US005803161A

United States Patent [19]

Wahle et al.

[11] Patent Number: 5,803,161

[45] Date of Patent: Sep. 8, 1998

[54] HEAT PIPE HEAT EXCHANGER FOR COOLING OR HEATING HIGH TEMPERATURE/HIGH-PRESSURE SUB-SEA WELL STREAMS

[75] Inventors: Harold W. Wahle, North Canton, Ohio; Robert J. Giammaruti, Caty, Tex.

[73] Assignee: The Babcock & Wilcox Company, New Orleans, La.

[21] Appl. No.: 954,185

[22] Filed: Nov. 12, 1997

Related U.S. Application Data

[63] Continuation of Ser. No. 707,787, Sep. 4, 1996, abandoned.

[51] Int. Cl.[6] ..... F28D 15/00

[52] U.S. Cl. ..... 165/104.21; 165/45; 166/335; 166/302; 62/260

[58] Field of Search ..... 165/104.27, 104.21, 165/45; 166/368, 302, 57, 61, 335; 62/260; 137/236.1; 405/159, 158, 157, 154

[56] References Cited

U.S. PATENT DOCUMENTS

| | | | |
|---|---|---|---|
| 3,648,767 | 3/1972 | Balch | 165/45 X |
| 3,685,583 | 8/1972 | Phares | 166/57 X |
| 3,756,268 | 9/1973 | Lefever et al. | 137/340 |
| 3,809,149 | 5/1974 | Deutsch | 62/260 X |
| 4,110,628 | 8/1978 | Paull et al. | 166/335 X |
| 4,125,159 | 11/1978 | Vann | 166/302 X |
| 4,199,953 | 4/1980 | Richter, Jr. et al. | 62/3 |
| 4,223,536 | 9/1980 | Ross et al. | 62/45 |
| 4,245,479 | 1/1981 | Richter, Jr. et al. | 62/119 |
| 4,327,801 | 5/1982 | Koizumi et al. | 165/104.21 |
| 4,339,929 | 7/1982 | Fitzpatrick et al. | 165/45 X |
| 4,369,373 | 1/1983 | Wiseman | 290/2 |
| 4,537,247 | 8/1985 | Okamoto et al. | 165/104.14 |
| 4,586,561 | 5/1986 | Franco et al. | 165/1 |
| 4,676,695 | 6/1987 | Duthweiler | 405/157 |
| 4,732,632 | 3/1988 | Pieslak et al. | 156/86 |
| 4,877,082 | 10/1989 | Collins, Jr. | 165/104.26 |
| 4,976,308 | 12/1990 | Faghri | 165/10 |
| 5,529,115 | 6/1996 | Paterson | 165/104.33 |
| 5,586,441 | 12/1996 | Wilson et al. | 165/104.21 X |

FOREIGN PATENT DOCUMENTS

| | | | |
|---|---|---|---|
| 161391 | 7/1986 | Japan | 165/45 |
| 1 547 829 | 6/1979 | United Kingdom . | |
| 2 194 324 | 3/1988 | United Kingdom . | |
| 2 053 456 | 2/1991 | United Kingdom . | |

OTHER PUBLICATIONS

United Kingdom Patent Office Combined Search and Examintion Report under Sections 17 and 18(3). Dated Sep. 24, 1997. Entire paper.

*Primary Examiner*—Denise L. Ferensic
*Assistant Examiner*—Christopher Atkinson
*Attorney, Agent, or Firm*—Robert J. Edwards; Eric Marich

[57] ABSTRACT

A heat pipe heat exchanger for regulating the temperature of a wellstream fluid conveyed in a subsea pipeline from a wellhead has an annular reservoir surrounding a section of pipeline adjacent the wellhead. One or more heat pipes extend from the annular reservoir into the seawater. In a heat removal configuration, a working fluid is contained within the annular reservoir. The working fluid boils and is evaporated by heat from the wellstream fluid and forms a vapor, which rises upwardly into and is condensed within the heat pipes, releasing heat into the surrounding seawater. The recondensed working fluid flows back down into the reservoir to repeat the cycle. In a heat providing configuration, the working fluid is contained in the heat pipes, where it is boiled by heat transferred from the surrounding seawater. The resulting vapor rises upwardly into the annular reservoir and the heat is transferred to the cooler wellstream fluids. Other embodiments involve having the one or more heat pipes inserted through the pipeline wall.

8 Claims, 3 Drawing Sheets

Temperature $T_1$ > Temperature $T_2$
Pressure $P_1$ > Pressure $P_2$
Heat Flow $Q_1$ > Heat Flow $Q_2$

HEAT PIPE HEAT EXCHANGER FOR COOLING OR HEATING HIGH TEMPERATURE/HIGH-PRESSURE SUB-SEA WELL STREAMS

This is a continuation of application Ser. No. 08/707,787 filed Sep. 4, 1996, now abandoned.

FIELD AND BACKGROUND OF THE INVENTION

The present invention relates in general to gas and oil production from subsea sources and, in particular, to a heat exchanger for use on a subsea pipeline for maintaining an acceptable temperature of the gas and oil produced.

Heating and cooling of oil and gas produced from subsea wells is often desirable.

Initially, wellstream temperatures often exceed the maximum operating temperatures of downstream flowline coatings and insulation materials. These maximum operating temperatures are usually about 300° F. (149° C.).

Currently, known methods for cooling the wellstream employ conventional heat exchangers located adjacent the wellhead on the seabed. The cooling fluid is produced water pumped at high pressure from an associated production platform through a separate pipeline. The operation of the heat exchanger must be carefully controlled to prevent the wellstream temperature exiting from the heat exchanger from exceeding these maximum operating temperatures, and also to avoid overcooling the gas or oil wellstream. If the wellstream is overcooled, gas hydrate or wax plugs could form and block the flowline.

The gas temperature of a wellstream decreases dramatically as it expands and passes through the wellhead choke in the pipeline due to Joule-Thomson cooling. This can occur after startup of a subsea well with a gas cap and also during steady state operation. This cooling effect could also result in flowline pluggage by gas hydrate or wax formation downstream of the choke.

Chemical inhibitors, such as methanol, are commonly injected upstream of the wellhead choke to prevent gas hydrate formation. The wellstream pressure can also be reduced to prevent the temperature drop caused by the wellhead choke. The former technique is an expensive approach while the latter is not always possible. Alternatively, a heat exchanger could be used to add heat to the cold, expanded gas immediately downstream of the wellhead choke.

SUMMARY OF THE INVENTION

It is an object of the invention to provide an efficient solution for maintaining an acceptable operating temperature within a pipeline or flowline for a wellstream from an undersea source.

Accordingly, a heat pipe heat exchanger is located on the seabed adjacent the wellhead surrounding the pipeline. The heat pipe may be configured to provide heat to or remove heat from the pipeline and wellstream fluids carried therein.

In one embodiment of the invention, heat is removed from the pipeline contents. A configuration is provided in which the heat transfer working fluid surrounds the pipeline within an annular evaporator. The working fluid is boiled by the heat from the pipeline and the resulting vapor flows to a heat pipe extending above the pipeline into the seawater, where it condenses, releasing the heat energy. The condensed working fluid then returns to the annular evaporator by gravity to repeat the cycle.

An alternate embodiment for heating the wellstream is provided in which the heat transfer working fluid is contained within the heat pipe below the pipeline and is warmed by the surrounding seawater, causing it to boil. The vapor flows into an annulus surrounding the pipeline, where the heat energy from the vapor is transmitted into the pipeline and wellstream fluids contained therein. The condensed vapor then returns to the heat pipe to repeat the cycle.

In a further embodiment, a heat pipe is inserted directly into the wellstream fluids through a wall of the pipeline. A portion of the heat pipe extends outwardly from the pipeline into the seawater. The heat pipe conveys heat from the wellstream fluids when the working fluid is located in the portion of the heat pipe within the pipeline. The heat pipe will heat the wellstream when it is oriented such that the heat pipe extends below the pipeline and the working fluid is in the end of the heat pipe surrounded by seawater.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which preferred embodiments of the invention are illustrated.

DETAILED DESCRIPTION OF THE PREFERRED EMBODIMENTS

Figure 1:
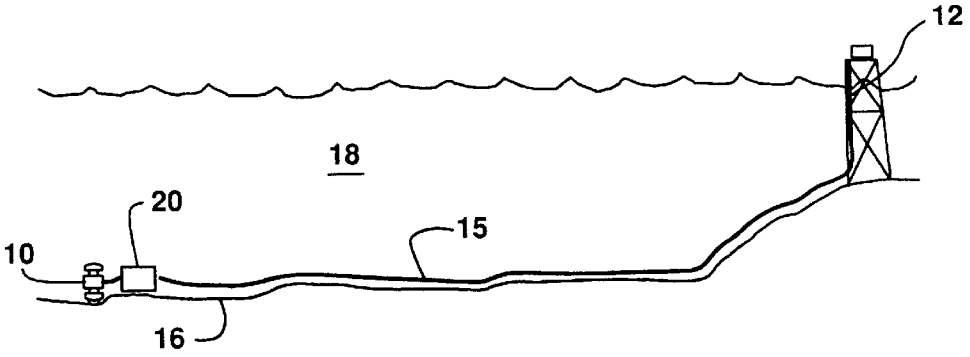
FIG. 1 is a schematic illustration of a subsea pipeline employing a heat pipe heat exchanger according to the invention.

Referring to the drawings in general, wherein like reference numerals designate the same or functionally similar elements throughout the several drawings, and to FIG. 1 in particular, there is shown in FIG. 1 a heat pipe heat exchanger 20 according to the invention placed downstream of a wellhead 10 connected to an underwater pipeline 15. The wellhead 10 and heat pipe heat exchanger 20 are located on a seabed 16 immersed in seawater 18. The pipeline 15 is connected to a production platform 12. Wellstream fluids 14 (not shown in FIG. 1) are pumped from the wellhead 10 through pipeline 15 to the production platform 12 for use.

Figure 2:
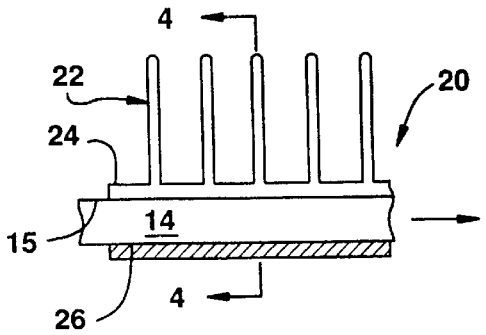
FIG. 2 is a side elevation sectional view of the heat exchanger of the invention.

In FIG. 2, a first embodiment of the heat pipe heat exchanger 20 is shown which can be used for removing heat from the wellstream fluids 14 contained in pipeline 15. The heat pipe heat exchanger 20 has an annular reservoir 24 surrounding pipeline 15. Fluidically connected thereto are one or more heat pipes 22 extending generally upwardly (i.e., in an opposite direction with respect to the direction of the force of gravity) from the annular reservoir 24. A heat transfer working fluid 26 is contained within the annular reservoir 24, and the fluidically connected heat pipes 22.

While FIG. 2 shows an arrangement of three rows of heat pipes 22 extending substantially radially from the annular reservoir 24, it will be appreciated that fewer or a greater number of rows may be employed, and also in arrangements other than radial. The important aspect to be observed is that in the case of a heat pipe heat exchanger 20 employed on a pipeline 15 to extract heat from the wellstream fluids 14 contained therein (as in FIGS. 2 and 4, and 6–7 described infra) the heat pipes 22 are located generally above the reservoir 24 of liquid working fluid 26. In this way, the absorption of heat from the wellstream fluids 14 causes the working fluid 26 to evaporate. The working fluid vapor flows by pressure difference up into the heat pipes 22, where the heat is rejected into the surrounding seawater 18, causing the working fluid 26 to condense on the inside surfaces and drain/return into the annular reservoir 24 by gravity. Note that heat is rejected directly to the surrounding seawater without the need for a secondary cooling fluid like produced water returned from a production platform.

The working fluid 26 may be one of water, ammonia, methanol, or any other suitable fluid having the required properties for use in a heat pipe heat exchanger.

Figure 4:
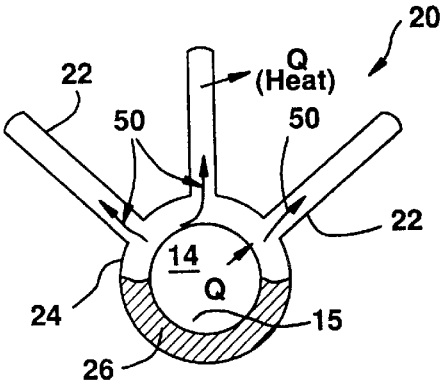
FIG. 4 is a sectional view taken in the direction of arrows 4—4 of FIG. 2.

Referring now to FIG. 4, the arrows marked Q indicate heat flow. In this embodiment wherein heat is being removed form the wellstream fluids 14, the working fluid 26 is heated by the conduction of heat from the wellstream fluids 14 through the wall of the pipeline 15. The heat Q causes the working fluid 26 to boil and evaporate, creating a vapor indicated by arrows 50. The vapor 50 flows upwardly into the one or more heat pipes 22, and the heat 50 is conducted through the wall of the pipeline 15 into the cooler seawater 18 surrounding the heat pipes 22. This heat transfer Q from the vapor 50 state working fluid 26 causes the vapor 50 to condense back into liquid working fluid 26. Heat Q is released by the condensation of vapor 50, and the recondensed working fluid 26 drains back down into annular reservoir 24 to repeat the cycle.

Figure 3:
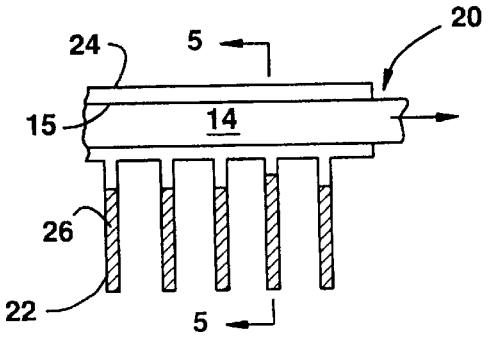
FIG. 3 is a side elevation sectional view of an alternate configuration of the heat exchanger of FIG. 2.
Figure 5:
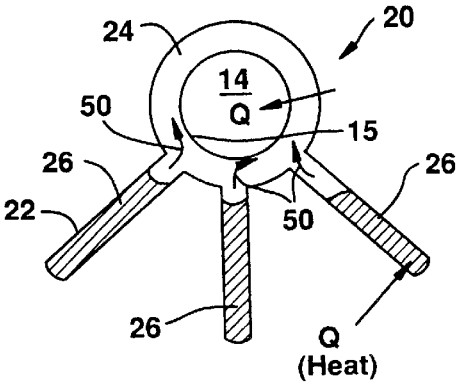
FIG. 5 is a sectional view taken in the direction of arrows 5—5 of FIG. 3.

FIGS. 3 and 5 show an alternate configuration in which the heat pipe heat exchanger 20 is oriented to provide heat Q into the wellstream fluids 14 contained in pipeline 15. In this configuration, the heat pipes 22 are positioned generally below the annular reservoir 24. The liquid phase or state of the working fluid 26 is thus contained within the heat pipes 22. Seawater 18 surrounding the heat pipes 22 transfers heat Q to a properly selected working fluid 26, which then boils on the inside surface of the heat pipes 22, creating vapor 50. This vapor 50 flows upwardly by pressure difference into the annular reservoir 24 and is condensed by contact with the cooler outside surface of the flowline or pipeline 15 which contains the wellstream fluids 14 to be heated. This transfers heat into the colder wellstream fluids 14. The condensed working fluid 26 drains back down into the heat pipes 22, as the heat Q is transferred into the wellstream fluids 14 through the wall of the pipeline 15, to repeat the cycle. The important aspect to be observed is that in the case of a heat pipe heat exchanger 20 employed on a pipeline 15 to add heat to the wellstream fluids 14 contained therein, the heat pipes 22 are located generally below the reservoir 24 and contain the liquid working fluid 26. In this way, the absorption of heat from the seawater 18 in the heat pipes 22 causes the working fluid 26 to evaporate and rise up into the annular reservoir 24, where the heat is conveyed into the wellstream fluids 14, causing the working fluid 26 to condense and return into the heat pipes 22 by gravity. Again, no secondary cooling fluid like produced water is required to accomplish this heat addition to the wellstream fluids 14.

The configuration of FIGS. 3 and 5 is useful for transferring heat to the wellstream fluids 14 at a point downstream of a wellhead choke to prevent formation of gas hydrates and wax plugs within the pipeline 15. Again, various numbers and configurations of heat pipes 22 may be employed as described in connection with the embodiments of FIGS. 2 and 4.

In each of the previous embodiments of FIGS. 2–5, (and FIGS. 7A–7E, infra) the actual flow of the wellstream fluids 14 within pipeline 15 is not restricted or otherwise affected by the addition of the heat pipe heat exchanger 20 thereto.

Figure 6:
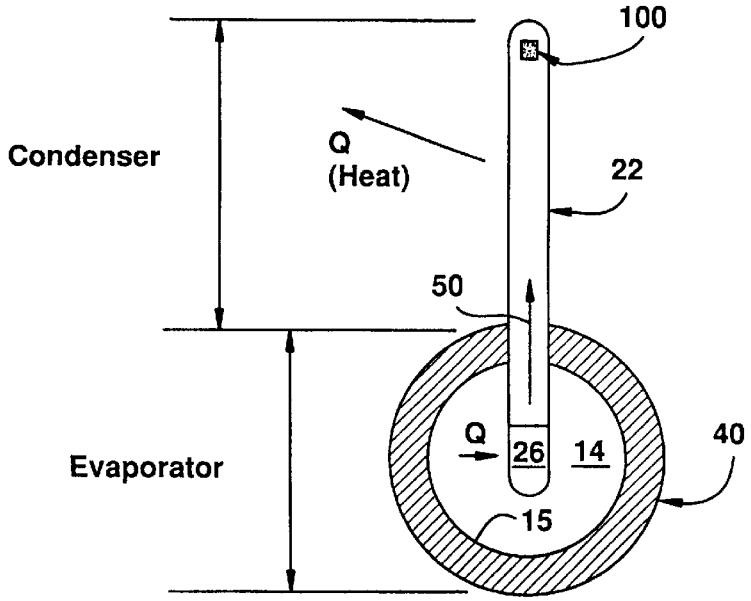
FIG. 6 is a sectional end view of another embodiment of a heat pipe heat exchanger according to the present invention.
Figure 7A:
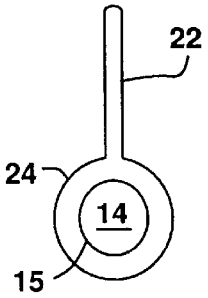
FIGS. 7A–7E are sectional end views of alternate arrangements and orientations of heat pipes for use with the heat exchanger of the present invention.
Figure 7B:
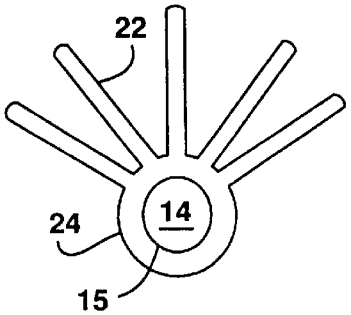
Figure 7C:
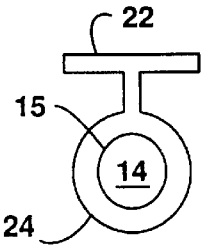
Figure 7D:
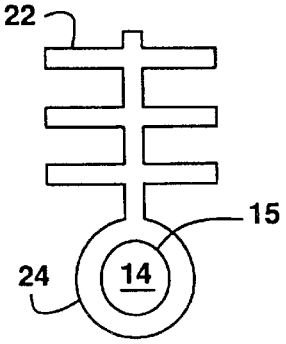
Figure 7E:
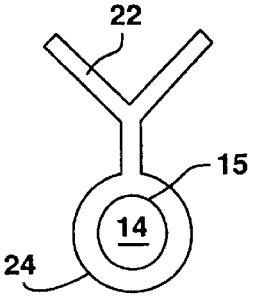

Another embodiment of the invention is shown in FIG. 6, used to remove heat from the wellstream fluids 14, in which the one or more heat pipes 22 actually extend through the wall of the pipeline 15 into the wellstream fluids 14. This allows direct heat exchange between the wellstream fluids 14 and the one or more heat pipes 22. As shown, the heat pipes 22 extend substantially upwardly above the pipeline 15 since this embodiment is configured for heat removal from the wellstream fluids 14. The heat pipes 22 may contain an optional hydrogen getter 100 of known composition, which can be used to prevent the formation of unwanted gases and compounds within the heat pipe 22. Insulation 40 can also be provided to surround pipeline 15 as well.

FIGS. 7A through 7E show alternate heat pipe 22 arrangements which are envisioned for use with the present invention. While FIGS. 7A–7E are shown for removal of heat from wellstream fluids 14, it will be readily understood that arrangements of heat pipes 22 for heat addition into the wellstream fluids 14 can be easily made by locating the heat pipes 22 of FIGS. 7A–7E as described earlier, such as with the embodiments of FIGS. 3 and 5.

In each of the disclosed embodiments, the heat exchange process is controlled by pre-selecting an appropriate working fluid 26 for the application and its design requirements. No additional control is required. The heat exchanger of the invention will continue to work efficiently even as the wellstream fluids 14 temperature decreases over time.

The heat pipe heat exchanger 20 according to the present invention can be fabricated from a simple pipe-in-pipe structure, and is economically efficient. Conventional materials such as carbon steel may be used for the heat pipes 22 if the surfaces exposed to seawater are coated with TEFLON® or other corrosion resistant materials. Hydrogen getters 100 may be used with any of the disclosed embodiments to prevent internal degradation of the heat pipes 22.

Further, as described above the function of the heat pipe heat exchanger 20 can be reconfigured from heating to cooling and vice versa simply by reorienting the heat pipes 22 in relation to the annular reservoir 24. By varying the number and size of the heat pipes, the effectiveness of the heat exchanger can be controlled as well.

Figure 8:
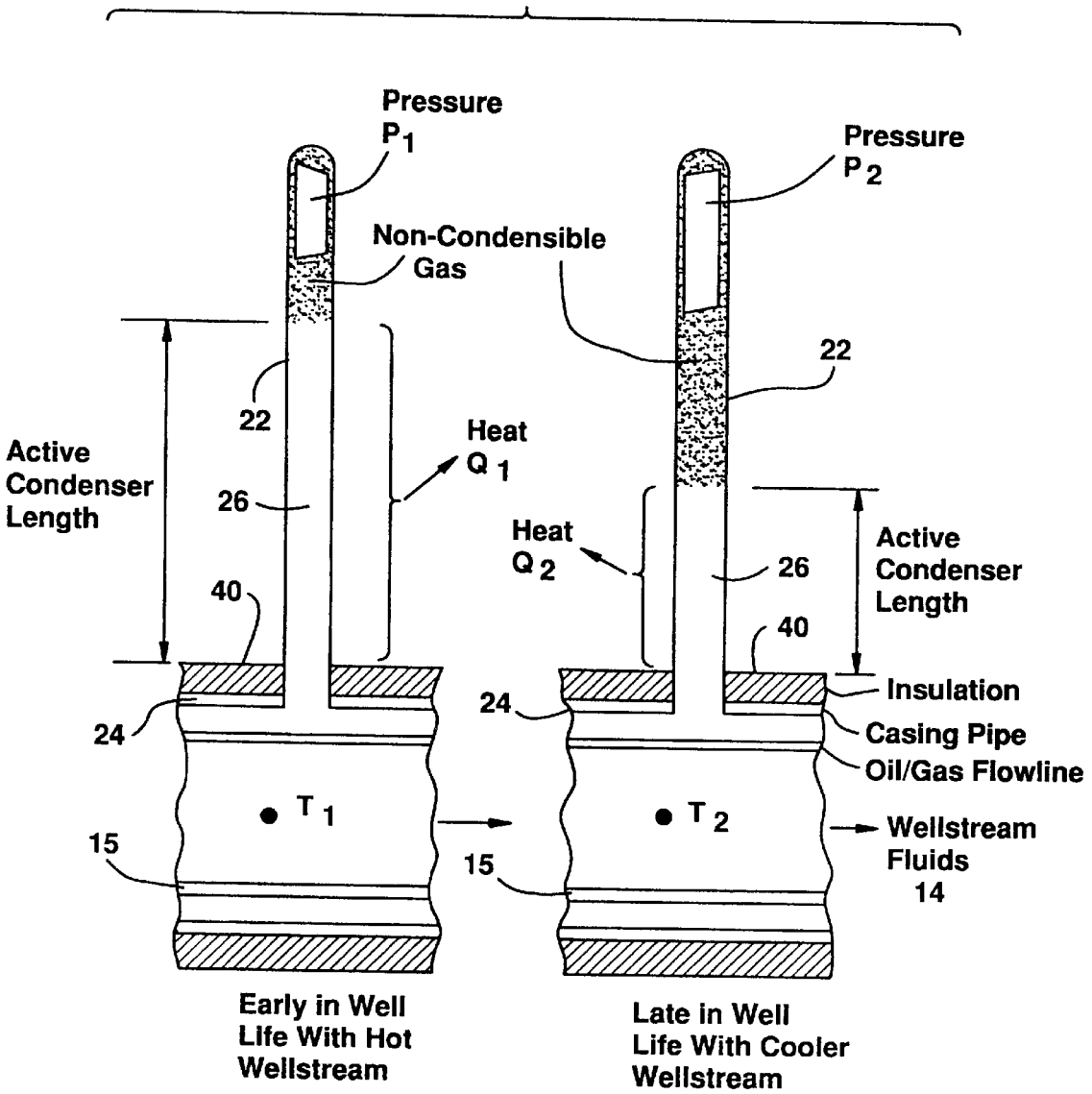
FIG. 8 is a sectional view of another embodiment of a heat pipe heat exchanger according to the present invention wherein an amount of inert, non-condensible gas is provided in the heat pipe heat exchanger to obtain a degree of passive outlet wellstream fluid temperature control.

An additional advantage of the present invention is its ability to obtain a degree of passive outlet wellstream fluid temperature control. This aspect is described as follows and in connection with FIG. 8. While conventional heat exchangers (tube-and-shell and tube-in-tube) would normally require a control system to maintain the outlet wellstream fluids 14 temperature below a specified maximum value, or so as not to overcool the wellstream fluids 14 as the wellhead aged over time, the heat pipe heat exchanger 20 of the present invention can be engineered to passively control outlet temperatures. This is accomplished by the use of a known amount of inert, non-condensible gas (such as argon) which is provided in the heat pipe heat exchanger 20 along with the working fluid 26. Initially, when the wellstream fluids 14 from the wellhead 10 are hot, the working fluid 26 would operate at a relatively high saturation temperature which would compress the non-condensible gas into a small volume at the end of the heat pipes 20 during operation. This non-condensible gas "pocket" blocks a small portion of the heat transfer surface area within the heat pipes 22 and causes it to be inactive. However, as the well ages and the wellstream fluids 14 produced thereby decrease in source temperature, the working fluid 26 temperature and saturation pressure would also reduce. This would allow the non-condensible gas pocket to expand, covering more of the heat pipe 22 heat transfer surface and preventing steam from condensing thereon. By reducing the surface area available for heat transfer, less wellstream fluids 14 temperature drop would occur as it passed through the heat pipe heat exchanger 20. Such passive temperature regulation requires no external control system or power.

The heat pipe heat exchanger according to the present invention thus has several advantages. It is a completely passive design with no moving parts, and no power requirement or controls. Some embodiments of the invention allow for full bore flowlines or pipelines 15 that would permit pipeline "pigs" to pass therethrough for cleaning. Simple fabrication is involved by using standard pipe or tube and welded pipe-in-pipe design. The heat pipe heat exchanger according to the present invention transfers heat directly to the surrounding seawater, while conventional shell and tube or tube-in-tube heat exchangers require a secondary fluid stream to transfer heat with the wellstream fluids. Produced water is normally returned from the production platform through a separate pipeline to the conventional sub-sea heat exchangers. Accordingly, a heat pipe heat exchanger according to the present invention could eliminate many miles of secondary fluid pipeline between the production platform and the wellhead. Depending on well requirements, heat can be either added to or removed from the wellstream fluids, and the flexibility of the design is apparent in that the number, size, and location of the heat pipes and the working fluid are design parameters that can be varied to meet specific sub-sea heat pipe heat exchanger applications. If necessary, enhanced surface can be used on the inside surfaces of the flow line to increase surface area, thus increasing heat transfer with the wellstream fluids. Enhanced surface can also be used on the outside surface of the heat pipes themselves, thus increasing the heat transfer capability with the seawater. This enhanced surface can be any of the conventional forms including longitudinal or transverse fins. The present invention is less expensive to manufacture, since high flow line pressures, high produced water pressures, and external hydrostatic seawater pressures traditionally dictate high pressure designs. The use of produced water as the secondary coolant in traditional approaches also dictates the use of expensive corrosion-resistant alloys like titanium. The heat pipe heat exchanger according to the present invention is a relatively simple pipe-in-pipe construction with only flow line pressure and hydrostatic head to deal with. Without high-pressure, corrosive produced water, the heat pipe heat exchanger design of the present invention is relatively simple and less expensive alloys can be used. Predictable life is obtained in that hydrogen gas generated by the corrosion process and which can deffuse into the working fluid volume can be addressed by the provision of low-temperature hydrogen getters placed inside the heat pipe to prevent performance degradation with time.

While specific embodiments of the invention have been shown and described in detail to illustrate the application of the principles of the invention, it will be understood that the invention may be embodied otherwise without departing from such principles.

We claim:

1. A heat pipe exchanger for a subsea pipeline conveying a wellstream fluid from a wellhead to an above-surface installation, comprising:

an annular reservoir surrounding a section of the subsea pipeline conveying the wellstream fluid and sealedly connected thereto;

at least one heat pipe extending from and in fluidic communication with the annular reservoir; and a working fluid contained within one of the annular reservoir and the at least one heat pipe.

2. The heat pipe heat exchanger according to claim 1, wherein the working fluid is selected from one of water, methanol and ammonia.

3. The heat pipe exchanger according to claim 1, wherein the at least one heat pipe comprises at least one elongated tube having a first end connected to the annular reservoir, and a sealed second end extending into heat transfer relationship with surrounding seawater.

4. The heat pipe exchanger according to claim 3, wherein the at least one elongated tube further comprises a hydrogen getter within the tube adjacent the second end.

5. The heat pipe exchanger according to claim 1, wherein the at least one heat pipe extending from and in fluidic communication with the annular reservoir is oriented substantially above the annular reservoir to remove heat from the wellstream fluid.

6. The heat pipe exchanger according to claim 1, wherein the at least one heat pipe extending from and in fluidic communication with the annular reservoir is oriented substantially below the annular reservoir to introduce heat into the wellstream fluid.

7. The heat pipe heat exchanger according to claim 1, further comprising means for passively controlling a temperature of the wellstream fluid leaving said section of the subsea pipeline.

8. The heat pipe heat exchanger according to claim 7, wherein said means for passively controlling comprises a known amount of a non-condensible gas in the at least one heat pipe.

* * * * *